United States Patent [19]

Kita et al.

[11] Patent Number: 4,582,616

[45] Date of Patent: Apr. 15, 1986

[54] GENERAL-PURPOSE GREASE COMPOSITION

[75] Inventors: Takekatsu Kita; Makoto Ikeda; Akira Iseya, all of Ichihara, Japan

[73] Assignee: Idemitsu Kosan Company Limited, Tokyo, Japan

[21] Appl. No.: 637,852

[22] Filed: Aug. 6, 1984

[30] Foreign Application Priority Data

Aug. 23, 1983 [JP] Japan ..... 58-152483

[51] Int. Cl.[4] ..... C10M 129/28

[52] U.S. Cl. ..... 252/17; 252/39; 252/41; 252/40.7; 252/42.1

[58] Field of Search ..... 252/17, 39, 42.1, 40.7, 252/41

[56] References Cited

U.S. PATENT DOCUMENTS 3,630,901 12/1971 Messina et al. ..... 252/51

3,758,407 9/1973 Harting ..... 252/18

*Primary Examiner*—Jacqueline V. Howard

*Attorney, Agent, or Firm*—Frishauf, Holtz, Goodman & Woodward

[57] ABSTRACT

The general-purpose grease composition of the invention is usable in a wide temperature range or, in particular, at very low temperatures down to −50° C. The grease composition comprises, as the essential components, a lubricating base oil mainly composed of a deep-freeze dewaxed base oil having a fluidity point of −35° C. or below and a thickener which is typically a lithium soap such as lithium 12-hydroxystearate.

14 Claims, No Drawings

GENERAL-PURPOSE GREASE COMPOSITION

BACKGROUND OF THE INVENTION

The present invention relates to a general-purpose grease composition or, more particularly, to a general-purpose grease composition having excellent stability over a wide temperature range.

Needless to say, greases are widely used for the purpose of lubrication, rust-proofing, etc. in a great variety of machines such as freezing machines, traffic vehicles, bearings of rotatable shafts, pumps and many others. Accordingly, the temperature range in which the grease is used remarkably differs depending on the type of the machine. For example, greases used in a freezing machine should exhibit good performance even when the grease is at a very low temperature of −40° to −50° C. as refrigerated by the cooling medium. On the other hand, a grease used in the bearing of a vehicle sometimes encounters an extremely high temperature of 180° to 220° C. when the brake is actuated.

In the prior art, no single grease composition is available which simultaneously satisfies the rather incompatible requirements for the low vaporization loss at high temperatures and adequate torque at very low temperatures as specified in JIS (Japanese Industrial Standard) K 2220 for the greases of Grades 1 to 3 usable in bearings at high and low temperatures. This is mainly due to the properties of the lubricating base oil formulated in the preparation of grease compositions. Therefore, proper selection of the grease has been essential in each machine and for each purpose and troubles are unavoidable when a single grease composition should work satisfactorily in a wide temperature range.

SUMMARY OF THE INVENTION

An object of the present invention is to provide a grease composition usable in a wide temperature range, for example, from −50° C. to +200° C. and the extensive investigations undertaken by the inventors with this object have arrived at a discovery that a grease composition prepared by formulating a specific lubricating base oil and a metal soap is suitable for the purpose leading to the completion of the present invention.

Thus, the general-purpose grease composition of the present invention comprises a lubricating base oil mainly composed of a deep-freeze dewaxed base oil having a fluidity point of −35° C. or below and a thickener.

DETAILED DESCRIPTION OF THE PREFERRED EMBODIMENTS

As is mentioned above, the lubricating base oil formulated in the inventive general-purpose grease composition is mainly composed of a deep-freeze dewaxed base oil having a fluidity point of −35° C. or below. The deep-freeze dewaxed base oil here implied usually contains at least 95% by weight of the naphthenic hydrocarbons and paraffinic hydrocarbons as a total and has an iodine value of 7 or smaller, content of sulfurous matter of 10 ppm or smaller, content of nitrogenous matter of 5 ppm or smaller, fluidity point of −35° C. or below and kinematic viscosity in the range from 5 to 500 centistokes at 40° C. Such a deep-freeze dewaxed base oil can be prepared by subjecting the lubricating oil fraction from an intermediate crude oil to processing including hydrogenation treatment, distillation under reduced pressure, dewaxing and the like.

The lubricating base oil in the formulation of the inventive grease composition can be a blend of the above mentioned deep-freeze dewaxed base oil with one or more of synthetic oils. Suitable synthetic oils are exemplified by polyolefins, polyglycol esters, polyol esters, phosphoric acid esters, silicone fluids, alkyl diphenyls, dibasic acid esters and the like. Preferable ones among them are the dibasic acid esters such as, in particular, dioctyl sebacate, dioctyl azelate, dioctyl adipate and the like. Naphthenic machine oils are also usable as a component in the blend.

The lubricating base oil should contain at least 10% by weight or, preferably, at least 40% by weight of the deep-freeze dewaxed base oil as the principal ingredient.

The second essential component in the inventive grease composition is a thickener which serves to increase the consistency of the composition. The thickener used in the inventive grease composition is usually a metal soap selected from conventional ones used in the manufacture of grease compositions without particular limitations. Suitable metal soaps are the salts of a fatty acid, resin acid, naphthenic acid and the like and a metal such as lithium, sodium, calcium, aluminum, barium, lead and the like exemplified by lithium stearate, lithium 12-hydroxystearate, calcium acetate, calcium stearate, calcium palmitate and calcium oleate as well as mixtures thereof and complex soaps. Thickeners other than metal soaps such as bentonite-, urea- and silicone-based ones can be used either alone or as a combination with the metal soap.

The proportion of the lubricating base oil and the thickener such as the metal soap in the inventive grease composition should be determined with consideration of various factors. It is usual that 100 parts by weight of the lubricating base oil are formulated with from 3 to 30 parts by weight or, preferably, from 5 to 15 parts by weight of the thickener, e.g. metal soap.

The essential components in the inventive general-purpose grease composition are the above mentioned lubricating base oil and the thickener but it is of course optional that the grease composition is admixed with an antioxidant, metal deactivator, rust preventive, extreme pressure additive, solid lubricant and the like according to need. Suitable additives include 2,6-ditert-butyl p-methylphenol (DBPC), phenyl α-naphthylamine and the like as the antioxidant, benzotriazole as the metal deactivator, barium sulfonate and sorbitan monooleate as the rust preventive, sulfurized fats and oils and lead dithiophosphate as the extreme pressure additive and graphite and molybdenum disulfide as the solid lubricant.

The procedure for the preparation of the inventive general-purpose grease composition is not specifically limited. In the case of a grease with lithium 12-hydroxystearate as the thickener, for example, the metal soap is first added to a 20 to 30% portion of the lubricating base oil based on the overall formulation. The metal soap may be a ready-made material as such but it is usually prepared by the saponification of a fatty acid, resin acid and the like or a derivative thereof with addition of a metal compound. Thereafter, the mixture is heated at a temperature in the range from 180° to 210° C. or, preferably, from 190° to 200° C. to effect dehydration and dissolution of the metal soap followed by gradual temperature decrease to 180° to 170° C. Then, the reserved portion of the lubricating base oil is added to the mixture so as to rapidly cool down. Addition of the additives, if any, should be performed when the temperature of the mixture is 100° C. or below. Subsequent treatment of milling, deaeration and the like gives the general-purpose grease composition of the invention.

The general-purpose grease composition prepared in the above described procedure can well satisfy the requirements specified in the JIS in both of the high and low temperature ranges simultaneously. That is, the grease composition exhibits an evaporation loss remarkably small even at high temperatures and an adequately small torque at low temperatures so that the grease composition is suitable for general-purpose use in a wide variety of machines and applications in which the grease is required to work satisfactorily over a wide temperature range. Furthermore, the inventive grease composition has a fine butter-like texture with good appearance.

In the following, the inventive grease composition is described in more detail by way of Examples and Comparative Examples.

EXAMPLES 1, 2 AND 4 AND COMPARATIVE EXAMPLES 1, 2 AND 4

A 30% portion of the lubricating base oil indicated in Table 1 was admixed with 12-hydroxystearic acid and lithium hydroxide each in an amount corresponding to the lithium 12-hydroxystearate indicated in the same table under agitation and heated at 194° C. The temperature of the uniformized mixture was gradually decreased to 170° C. where the reserved portion of the lubricating base oil was added to the mixture so that the temperature of the mixture was rapidly decreased to 100° C. or below. Further, the additives indicated in Table 1 were added to the mixture and uniformly mixed together followed by milling and deaeration to give a grease composition. Table 1 summarizes the results of testing undertaken with these grease compositions. Properties of the lubricating base oil are shown in Table 2.

EXAMPLE 3 AND COMPARATIVE EXAMPLE 3

The formulations here were about the same excepting the replacement of the metal soap component in Examples 1, 2 and 4 and Comparative Examples 1, 2 and 4, respectively, with a combination of calcium hydroxide, stearic acid, acetic acid and hydrogenated palm oil each in an amount indicated in Table 1. The formulations and results of testing of these grease compositions are shown in Table 1.

TABLE 1

| | | | Example | | | | Comparative Example | | | |
|---|---|---|---|---|---|---|---|---|---|---|
| | | | 1 | 2 | 3 | 4 | 1 | 2 | 3 | 4 |
| Formulation, % by weight | Lubricating base oil*1 | I | 18 | 59 | 45.5 | 87 | — | — | — | — |
| | | II | 40 | — | — | — | — | — | — | — |
| | | III | 30 | — | 37.5 | — | 30 | — | 37.5 | — |
| | | Dioctyl sebacate | — | 30 | — | — | — | 30 | — | — |
| | | IV | — | — | — | — | 18 | — | — | 87 |
| | | V | — | — | — | — | 40 | — | 45.5 | — |
| | | VI | — | — | — | — | — | 59 | — | — |
| | Metal soap | Lithium 12-hydroxystearate | 8 | 8 | — | 9 | 8 | 8 | — | 9 |
| | | Calcium hydroxide | — | — | 3.7 | — | — | — | 3.7 | — |
| | | Stearic acid | — | — | 1.1 | — | — | — | 1.1 | — |
| | | Acetic acid | — | — | 3.5 | — | — | — | 3.5 | — |
| | | Hydrogenated palm oil | — | — | 6.4 | — | — | — | 6.4 | — |
| | Additives | Antioxidant (DBPC) | 1 | 1 | 1 | 1 | 1 | 1 | 1 | 1 |
| | | Rust preventive | 3 | 2 | 1.3 | 3 | 3 | 2 | 1.3 | 3 |
| Results of testing | Consistency*2 | | 290 | 280 | 270 | 278 | 275 | 275 | 270 | 280 |
| | Dripping point, °C.*2 | | 199 | 185 | >300 | 193 | 199 | 180 | >300 | 199 |
| | Evaporation loss, % by weight*3 | | 1.21 | 1.30 | 0.61 | 2.60 | 0.45 | 6.53 | 0.60 | 2.34 |
| | Torque at low temperature, g. f. cm | −30° C. Torque at starting | 3150 | 260 | 1900 | 975 | 3835 | 1170 | 3700 | 6175 |
| | | −30° C. Torque in rotation | 748 | 130 | 1050 | 325 | 1950 | 390 | 850 | 3090 |
| | | −40° C. Torque at starting | 5900 | 650 | 3230 | 1950 | *4 | 2020 | *4 | 9850 |
| | | −40° C. Torque in rotation | 1690 | 325 | 1940 | 650 | *4 | 780 | *4 | 4300 |
| | | −54° C. Torque at starting | *4 | 1755 | *4 | 11380 | *4 | *4 | *4 | *4 |
| | | −54° C. Torque in rotation | *4 | 400 | *4 | 5200 | *4 | *4 | *4 | *4 |
| | Color | | Light brown | Light Yellow | Light brown | Light yellow | Brown | Yellow | Brown | Yellow |

*1See Table 2.
*2Measured according to JIS K 2220
*3Measured according to Method B in JIS K 2220 at 99° C. after 22 hours
*4Not measurable

TABLE 2

| Lubricating base oil | I | II | III | IV | V | VI |
|---|---|---|---|---|---|---|
| % $C_N$ + % $C_P$* | 99.2 | 99.8 | 73.3 | 94.8 | 96.6 | 88.8 |
| Iodine value | <1 | 1 | 30 | 3 | 4 | 8 |
| Sulfurous matter, ppm | <1 | <1 | 21 | 83 | 100 | 2 |
| Nitrogenous matter, ppm | <5 | <5 | 1500 | <5 | <5 | <5 |
| Fluidity point, °C. | −42.5 | −45 | −12.5 | −20 | −15 | −27.5 |
| Kinematic viscosity at 40° C., cSt | 36.37 | 106.6 | 250 | 31.2 | 91.7 | 7.8 |

*Total content of naphthenic hydrocarbons (% $C_N$) and paraffinic hydrocarbons (% $C_P$)
Types of lubricating base oils
I: Deep-freeze dewaxed base oil, hydrogenation dewaxing 150N
II: Deep-freeze dewaxed base oil, hydrogenation dewaxing 500N
III: Naphthene 120 machine oil
IV: Paraffin 150N
V: Paraffin 500N
VI: Paraffinic mineral oil, content of paraffins 54% by weight, viscosity at 40° C. 78 cSt

What is claimed is:

1. A general-purpose grease composition which comprises a lubricating base oil said oil being mainly composed of a deep-freeze dewaxed base oil having a fluidity point of −35° C. or below and an amount of a metal soap thickener in the range of from 3 to 30 parts by weight per 100 parts by weight of the lubricating base oil, and wherein the deep-freeze dewaxed base oil contains at least 95% by weight of naphthenic hydrocarbons and paraffinic hydrocarbons as a total and has an iodine value of 7 or smaller, sulfurous matter content of 10 ppm or smaller, nitrogenous matter content of 5 ppm or smaller and a kinematic viscosity in the range from 5 to 500 centistokes at 40° C.

2. The general-purpose grease composition as claimed in claim 1 wherein the lubricating base oil contains at least 40% by weight of the deep-freeze dewaxed base oil.

3. The general-purpose grease composition as claimed in claim 1 wherein the metal soap is a metal soap selected from the group consisting of lithium stearate, lithium 12-hydroxystearate, calcium acetate, calcium stearate, calcium palmitate, calcium oleate and mixtures thereof.

4. The general-purpose grease composition as claimed in claim 3 wherein the metal soap is lithium 12-hydroxystearate.

5. The general-purpose grease composition as claimed in claim 1 wherein the amount of the metal soap is in the range from 5 to 15 parts by weight per 100 parts by weight of the lubricating base oil.

6. The general-purpose grease composition as claimed in claim 1 wherein the grease composition is admixed with an antioxidant.

7. The general-purpose grease composition as claimed in claim 1 wherein the grease composition is admixed with a metal deactivator.

8. The general-purpose grease composition as claimed in claim 1 wherein the grease composition is admixed with a rust preventive.

9. The general-purpose grease composition as claimed in claim 1 wherein the grease composition is admixed with an extreme pressure additive.

10. The general-purpose grease composition as claimed in claim 1 wherein the grease composition is admixed with a solid lubricant.

11. The general-purpose grease composition as claimed in claim 3 wherein the amount of the metal soap is in the range from 5 to 15 parts by weight per 100 parts by weight of the lubricating base oil.

12. The general-purpose grease composition as claimed in claim 11 wherein the lubricating base oil contains at least 40% by weight of the deep-freeze dewaxed base oil.

13. The general-purpose grease composition as claimed in claim 12 wherein the metal soap is lithium 12-hydroxystearate.

14. The general-purpose grease composition as claimed in claim 13 wherein said grease composition contains at least one additive selected from the group consisting of an antioxidant, a metal deactivator and a rust preventive.

* * * * *